US009840887B2

(12) United States Patent
Zhao et al.

(10) Patent No.: US 9,840,887 B2
(45) **Date of Patent: *Dec. 12, 2017**

(54) WEAR-RESISTANT AND SELF-LUBRICANT BORE RECEPTACLE PACKOFF TOOL

(71) Applicants: Lei Zhao, Houston, TX (US); Zhiyue Xu, Cypress, TX (US); Guijun Deng, The Woodlands, TX (US)

(72) Inventors: Lei Zhao, Houston, TX (US); Zhiyue Xu, Cypress, TX (US); Guijun Deng, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/710,674

(22) Filed: May 13, 2015

(65) Prior Publication Data

US 2016/0333657 A1 Nov. 17, 2016

(51) Int. Cl.
*E21B 33/12* (2006.01)

(52) U.S. Cl.
CPC ..... *E21B 33/1212* (2013.01); *E21B 33/1208* (2013.01)

(58) Field of Classification Search
CPC .... E21B 2033/005; E21B 4/003; E21B 10/25; E21B 33/00; E21B 33/1216; E21B 33/128; E21B 33/12; E21B 33/1208; F16J 15/3212; F16J 15/328; F16J 15/3208; F16J 15/32
See application file for complete search history.

(56) References Cited

U.S. PATENT DOCUMENTS

| | | | | |
|---|---|---|---|---|
| 3,807,996 | A | 4/1974 | Sara | |
| 3,904,405 | A | 9/1975 | Russell et al. | |
| 3,981,427 | A | 9/1976 | Brookes | |
| 4,116,451 | A * | 9/1978 | Nixon | F16J 15/30 277/336 |
| 4,205,858 | A | 6/1980 | Shimazaki et al. | |

(Continued)

FOREIGN PATENT DOCUMENTS

| | | |
|---|---|---|
| CA | 2429780 A1 | 12/2003 |
| CN | 102775669 | 11/2012 |

(Continued)

OTHER PUBLICATIONS

Baxter et al., "Microstructure and solid particle erosion of carbon-based materials used for the protection of highly porous carbon-carbon composite thermal insulation", Journal of Materials Science, vol. 32, 1997, pp. 4485-4492.

(Continued)

*Primary Examiner* — Eugene G Byrd
(74) *Attorney, Agent, or Firm* — Cantor Colburn LLP

(57) ABSTRACT

A packoff assembly comprises: a tubing connectable mandrel; and at least one packoff element disposed on the mandrel; the packoff element comprising an annular seal comprising a carbon composite and having an inner surface and an opposing outer surface; the inner surface being in contact with a surface of the mandrel; a wear-resistant member at least partially encapsulating the seal; an annular guide member disposed on the mandrel; and a retainer member disposed between the guide member and the mandrel for securing the guide member to a predetermined position on the mandrel.

27 Claims, 4 Drawing Sheets

(56) References Cited

U.S. PATENT DOCUMENTS 4,234,638 A * 11/1980 Yamazoe ..... C04B 14/022 264/112
4,372,393 A 2/1983 Baker
4,426,086 A 1/1984 Fournie et al.
4,743,033 A * 5/1988 Guess ..... E21B 33/126 166/319
4,798,771 A 1/1989 Vogel
4,799,956 A 1/1989 Vogel
4,826,181 A * 5/1989 Howard ..... F16J 15/20 277/539
4,885,218 A 12/1989 Andou et al.
5,117,913 A 6/1992 Thernig
5,134,030 A * 7/1992 Ueda ..... F16J 15/20 277/537
5,163,692 A * 11/1992 Schofield ..... F16J 15/3236 277/436
5,195,583 A 3/1993 Toon et al.
5,201,532 A 4/1993 Salesky et al.
5,225,379 A 7/1993 Howard
5,228,701 A * 7/1993 Greinke ..... C04B 35/536 264/291
5,247,005 A 9/1993 Von Bonin et al.
5,257,603 A 11/1993 Bauer et al.
5,283,121 A 2/1994 Bordner
5,286,574 A 2/1994 Foster et al.
5,362,074 A * 11/1994 Gallo ..... F02F 11/002 277/592
5,392,982 A 2/1995 Li
5,455,000 A 10/1995 Seyferth et al.
5,467,814 A 11/1995 Hyman et al.
5,494,753 A 2/1996 Anthony
5,495,979 A 3/1996 Sastri et al.
5,499,827 A * 3/1996 Suggs ..... F16J 15/22 277/537
5,522,603 A * 6/1996 Naitou ..... F16J 15/30 277/539
5,597,168 A * 1/1997 Antonini ..... F16J 15/3272 277/551
5,730,444 A 3/1998 Notter
5,765,838 A * 6/1998 Ueda ..... F16J 15/22 277/580
5,791,657 A 8/1998 Cain et al.
5,968,653 A 10/1999 Coppella et al.
5,992,857 A * 11/1999 Ueda ..... F16J 15/104 277/592
6,020,276 A 2/2000 Hoyes et al.
6,027,809 A 2/2000 Ueda et al.
6,065,536 A 5/2000 Gudmestad et al.
6,075,701 A 6/2000 Ali et al.
6,105,596 A * 8/2000 Hoyes ..... F16J 15/30 137/15.17
6,128,874 A 10/2000 Olson et al.
6,131,651 A 10/2000 Richy, III
6,152,453 A 11/2000 Kashima et al.
6,161,838 A 12/2000 Balsells
6,182,974 B1 * 2/2001 Harrelson, III ..... F16J 15/184 277/531
6,234,490 B1 5/2001 Champlin
6,258,457 B1 * 7/2001 Ottinger ..... B32B 9/04 277/936
6,273,431 B1 * 8/2001 Webb ..... F16J 15/20 277/529
6,383,656 B1 5/2002 Kimura et al.
6,506,482 B1 1/2003 Burton et al.
6,581,682 B1 6/2003 Parent et al.
6,585,053 B2 7/2003 Coon et al.
6,789,634 B1 9/2004 Denton
6,880,639 B2 4/2005 Rhodes et al.
7,105,115 B2 9/2006 Shin
7,470,468 B2 12/2008 Mercuri et al.
7,666,469 B2 2/2010 Weintritt et al.
9,325,012 B1 4/2016 Xu et al.
2001/0003389 A1 * 6/2001 Pippert ..... F16J 15/22 277/627
2002/0114952 A1 8/2002 Ottinger et al.
2002/0140180 A1 * 10/2002 Waltenberg ..... F16J 15/128 277/627
2003/0137112 A1 7/2003 Richter et al.
2004/0026085 A1 2/2004 Vacik et al.
2004/0097360 A1 5/2004 Benitsch et al.
2004/0127621 A1 7/2004 Drzal et al.
2004/0155382 A1 8/2004 Huang et al.
2004/0186201 A1 9/2004 Stoffer et al.
2006/0042801 A1 3/2006 Hackworth et al.
2006/0220320 A1 10/2006 Potier et al.
2006/0272321 A1 12/2006 Mockenhaupt et al.
2006/0272806 A1 12/2006 Wilkie et al.
2007/0009725 A1 1/2007 Noguchi et al.
2007/0054121 A1 3/2007 Weintritt et al.
2007/0142547 A1 6/2007 Vaidya et al.
2007/0257405 A1 11/2007 Freyer
2008/0128067 A1 6/2008 Sayir et al.
2008/0175764 A1 7/2008 Sako
2008/0289813 A1 11/2008 Gewily et al.
2009/0075120 A1 3/2009 Cornie et al.
2009/0151847 A1 6/2009 Zhamu et al.
2009/0189358 A1 7/2009 Briscoe et al.
2009/0194205 A1 8/2009 Loffler et al.
2009/0302552 A1 * 12/2009 Leinfelder ..... F16J 15/122 277/608
2010/0098956 A1 4/2010 Sepeur et al.
2010/0122821 A1 5/2010 Corre et al.
2010/0143690 A1 6/2010 Romero et al.
2010/0203340 A1 8/2010 Ruoff et al.
2010/0207055 A1 8/2010 Ueno et al.
2011/0033721 A1 2/2011 Rohatgi
2011/0045724 A1 2/2011 Bahukudumbi
2012/0107590 A1 5/2012 Xu et al.
2013/0001475 A1 1/2013 Christ et al.
2013/0192853 A1 8/2013 Themig
2013/0287326 A1 10/2013 Porter et al.
2013/0292138 A1 11/2013 Givens et al.
2014/0051612 A1 2/2014 Mazyar et al.
2014/0127526 A1 5/2014 Etschmaier et al.
2014/0224466 A1 8/2014 Lin et al.
2014/0272592 A1 9/2014 Thompkins et al.
2015/0034316 A1 2/2015 Hallundbäk et al.
2015/0068774 A1 3/2015 Hallundbäk et al.
2015/0158773 A1 6/2015 Zhao et al.
2015/0267816 A1 * 9/2015 Boskovski ..... F16J 15/3208 277/553
2016/0089648 A1 3/2016 Xu et al.
2016/0108703 A1 4/2016 Xu et al.
2016/0130519 A1 5/2016 Lei et al.
2016/0136923 A1 5/2016 Zhao et al.
2016/0136928 A1 5/2016 Zhao et al.
2016/0138359 A1 5/2016 Zhao et al.
2016/0145965 A1 5/2016 Zhao et al.
2016/0145966 A1 * 5/2016 Zhao ..... F16J 15/022 277/336
2016/0145967 A1 5/2016 Zhao et al.
2016/0146350 A1 5/2016 Zhao et al.
2016/0160602 A1 * 6/2016 Ruffo ..... E21B 33/1208 166/386
2016/0176764 A1 6/2016 Xu et al.
2016/0186031 A1 6/2016 Zhao et al.
2016/0333657 A1 11/2016 Zhao et al.

FOREIGN PATENT DOCUMENTS

EP 0747615 B1 10/2001
EP 2056004 A1 5/2009
EP 2586963 A1 5/2013
JP 2014141746 8/2014
WO 9403743 2/1994
WO 03102360 12/2003
WO 2004015150 A2 2/2004
WO 2005115944 12/2005
WO 2007138409 A1 12/2007

(56) References Cited

FOREIGN PATENT DOCUMENTS

| | | |
|---|---|---|
| WO | 2008021033 A2 | 2/2008 |
| WO | 2011039531 A1 | 4/2011 |
| WO | 2014028149 | 2/2014 |

OTHER PUBLICATIONS

Etter et al., "Aluminium carbide formation in interpenetrating graphite/aluminium composites", Materials Science and Engineering, Mar. 15, 2007, vol. 448, No. 1, pp. 1-6.

Hutsch et al., "Innovative Metal-Graphite Composites as Thermally Conducting Materials", PM2010 World Congress—PM Functional Materials—Heat Sinks, 2010, 8 pages.

Levin et al., "Solid Particle Erosion Resistance and High Strain Rate Deformation Behavior of Inconel-625 Alloy", Superalloys 718, 625, 706 and Various Derivatives, The Minerals, Metals & Materials Society, 1997, 10 pages.

Miyamoto et al., "Development of New Composites; Ceramic Bonded Carbon", Transactions of JWRI, vol. 38, No. 2, 2009, pp. 57-61.

Moghadam et al, "Functional Metal Matrix Composites: Self-lubricating, Self-healing, and Nanocomposites-An Outlook", The Minerals, Metals & Materials Society, Apr. 5, 2014, 10 pages.

Pohlmann et al., "Magnesium alloy-graphite composites with tailored heat conduction properties for hydrogen storage applications", International Journal of Hydrogen Energy, 35 (2010), pp. 12829-12836.

Tikhomirov et al., "The chemical vapor infiltration of exfoliated graphite to produce carbon/carbon composites", Carbon, 49 (2011), pp. 147-153.

Yang et al., "Effect of tungsten addition on thermal conductivity of graphite/copper composites", Composites Part B: Engineering, May 31, 2013, vol. 55, pp. 1-4.

International Search Report, International Application No. US/2016/027100, dated Jul. 20, 2016, Korean Intellectual Property Office; International Search Report 3 pages.

Rashad et al. "Effect of of Graphene Nanoplatelets addition on mechanical properties of pure aluminum using a semi-powder method", Materials International, Apr. 20, 2014, vol. 24, pp. 101-108.

Written Opinion of the International Searching Authority, International Application No. PCT/US2016/027100, dated Jul. 20, 2016, Korean Intellectual Property Office; Written Opinion 10 pages.

* cited by examiner

WEAR-RESISTANT AND SELF-LUBRICANT BORE RECEPTACLE PACKOFF TOOL

BACKGROUND

There are many different downhole tools in the oil and gas industry which require that a seal be established in the annulus between a fluid transmission conduit or tubing string disposed in a well bore and the outer well casing. These tools may relate to the drilling and completion of the well, the production of the well, the servicing of the well, or the abandonment of the well. In addition to conventional packers, polished bore receptacle (PBR) packoffs have also been used to isolate the production-tubing conduit or setting tools from the annulus. Current PBR packoffs typically include a seal member formed from plastics and rubbers. However, plastics and rubbers are prone to wear caused by high temperature, high pressure, and corrosive environments such as found in the oil and gas industry. Accordingly, seals formed from plastics and rubbers may experience a limited service life or are restricted from certain service environments. Furthermore, the large friction between plastic or rubber seals and PBR bore requires large setting force, which can increase the operating costs as well as roll-over failures. Thus the industry would be receptive to new packoffs having improved wear-resistant and lubrication properties.

BRIEF DESCRIPTION

The above and other deficiencies in the prior art are overcome by, in an embodiment, a packoff element comprising a carbon composite; a wear-resistant member at least partially encapsulating the seal; and a guide member disposed on an end of the packoff element.

In another embodiment, a packoff assembly comprises: a tubing connectable mandrel; and at least one packoff element disposed on the mandrel; the packoff element comprising: an annular seal comprising a carbon composite and having an inner surface and an opposing outer surface; the inner surface being in contact with a surface of the mandrel; a wear-resistant member at least partially encapsulating the seal; an annular guide member disposed on the mandrel; and a retainer member disposed between the guide member and the mandrel for securing the guide member to a predetermined position on the mandrel.

A method of sealing comprises positioning at least one annular packoff element onto a mandrel; guiding the packoff element towards a wellbore casing; compressing the packoff element; and sealing an annular area between the mandrel and the wellbore casing.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
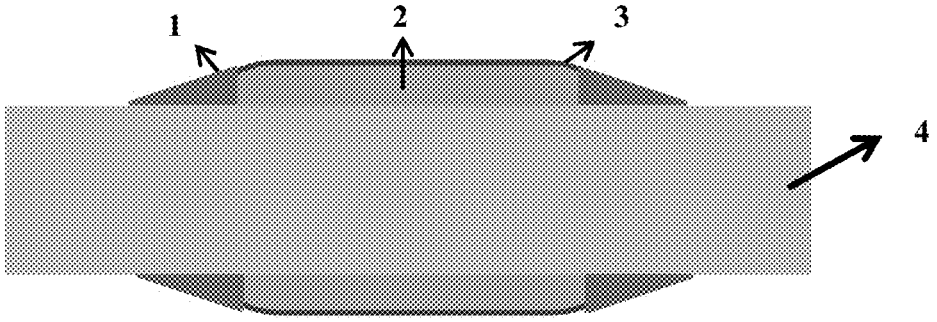
FIG. 1 illustrates the structure of a packoff assembly according to an embodiment of the disclosure.

The inventors hereof have found that carbon composites can be used to make polished bore receptacle packoffs. Compared with packoffs having a seal made from plastics or rubbers, packoffs containing carbon composites allow for reliable performance in much harsher high temperature high pressure and corrosive conditions. In addition, packoffs containing carbon composites dramatically reduce the setting force and minimize roll-over failures due to the self-lubrication properties of the carbon composites. A packoff element, for example, a polished bore receptacle packoff element of the disclosure comprises a carbon composite seal; a wear-resistant member at least partially encapsulating the seal; and a guide member disposed on an end of the packoff element. The utilization of wear-resistant member addresses the galling problem of conventional graphite materials, which further enables reliable performance of the packoffs.

The carbon composites in the seal comprise carbon and a binder. The carbon can be graphite. As used herein, graphite includes one or more of natural graphite; synthetic graphite; expandable graphite; or expanded graphite. Advantageously, the carbon composites comprise expanded graphite. Compared with other forms of the graphite, expanded graphite has high flexibility, high compression recovery, and larger anisotropy. The composites formed from expanded graphite and the binder can thus have excellent elasticity in addition to desirable mechanical strength.

In an embodiment, the carbon composites in the seal comprise carbon microstructures having interstitial spaces among the carbon microstructures; wherein the binder is disposed in at least some of the interstitial spaces. The interstitial spaces among the carbon microstructures have a size of about 0.1 to about 100 microns, specifically about 1 to about 20 microns. A binder can occupy about 10% to about 90% of the interstitial spaces among the carbon microstructures.

The carbon microstructures can also comprise voids within the carbon microstructures. The voids within the carbon microstructures are generally between about 20 nanometers to about 1 micron, specifically about 200 nanometers to about 1 micron. As used herein, the size of the voids or interstitial spaces refers to the largest dimension of the voids or interstitial spaces and can be determined by high resolution electron or atomic force microscope technology. In an embodiment, to achieve high elasticity for the seal, the voids within the carbon microstructures are not filled with the binder or a derivative thereof.

The carbon microstructures are microscopic structures of graphite formed after compressing graphite into highly condensed state. They comprise graphite basal planes stacked together along the compression direction. As used herein, carbon basal planes refer to substantially flat, parallel sheets or layers of carbon atoms, where each sheet or layer has a single atom thickness. The graphite basal planes are also referred to as carbon layers. The carbon microstructures are generally flat and thin. They can have different shapes and can also be referred to as micro-flakes, micro-discs and the like. In an embodiment, the carbon microstructures are substantially parallel to each other.

The carbon microstructures have a thickness of about 1 to about 200 microns, about 1 to about 150 microns, about 1 to about 100 microns, about 1 to about 50 microns, or about 10 to about 20 microns. The diameter or largest dimension of the carbon microstructures is about 5 to about 500 microns or about 10 to about 500 microns. The aspect ratio of the carbon microstructures can be about 10 to about 500, about 20 to about 400, or about 25 to about 350. In an embodiment, the distance between the carbon layers in the carbon microstructures is about 0.3 nanometers to about 1 micron. The carbon microstructures can have a density of about 0.5 to about 3 g/cm$^3$, or about 0.1 to about 2 g/cm$^3$.

In the carbon composites, the carbon microstructures are held together by a binding phase. The binding phase comprises a binder which binds carbon microstructures by mechanical interlocking. Optionally, an interface layer is formed between the binder and the carbon microstructures. The interface layer can comprise chemical bonds, solid solutions, or a combination thereof. When present, the chemical bonds, solid solutions, or a combination thereof may strengthen the interlocking of the carbon microstructures. It is appreciated that the carbon microstructures may be held together by both mechanical interlocking and chemical bonding. For example the chemical bonding, solid solution, or a combination thereof may be formed between some carbon microstructures and the binder or for a particular carbon microstructure only between a portion of the carbon on the surface of the carbon microstructure and the binder. For the carbon microstructures or portions of the carbon microstructures that do not form a chemical bond, solid solution, or a combination thereof, the carbon microstructures can be bound by mechanical interlocking. The thickness of the binding phase is about 0.1 to about 100 microns or about 1 to about 20 microns. The binding phase can form a continuous or discontinuous network that binds carbon microstructures together.

Exemplary binders include a nonmetal, a metal, an alloy, or a combination comprising at least one of the foregoing. The nonmetal is one or more of the following: $SiO_2$; Si; B; or $B_2O_3$. The metal can be at least one of aluminum; copper; titanium; nickel; tungsten; chromium; iron; manganese; zirconium; hafnium; vanadium; niobium; molybdenum; tin; bismuth; antimony; lead; cadmium; or selenium. The alloy includes one or more of the following: aluminum alloys; copper alloys; titanium alloys; nickel alloys; tungsten alloys; chromium alloys; iron alloys; manganese alloys; zirconium alloys; hafnium alloys; vanadium alloys; niobium alloys; molybdenum alloys; tin alloys; bismuth alloys; antimony alloys; lead alloys; cadmium alloys; or selenium alloys. In an embodiment, the binder comprises one or more of the following: copper; nickel; chromium; iron; titanium; an alloy of copper; an alloy of nickel; an alloy of chromium; an alloy of iron; or an alloy of titanium. Exemplary alloys include steel, nickel-chromium based alloys such as Inconel*, and nickel-copper based alloys such as Monel alloys. Nickel-chromium based alloys can contain about 40-75% of Ni and about 10-35% of Cr. The nickel-chromium based alloys can also contain about 1 to about 15% of iron. Small amounts of Mo, Nb, Co, Mn, Cu, Al, Ti, Si, C, S, P, B, or a combination comprising at least one of the foregoing can also be included in the nickel-chromium based alloys. Nickel-copper based alloys are primarily composed of nickel (up to about 67%) and copper. The nickel-copper based alloys can also contain small amounts of iron, manganese, carbon, and silicon. These materials can be in different shapes, such as particles, fibers, and wires. Combinations of the materials can be used.

The binder used to make the carbon composite is micro- or nano-sized. In an embodiment, the binder has an average particle size of about 0.05 to about 250 microns, about 0.05 to about 100 microns, about 0.05 to about 50 microns, or about 0.05 to about 10 microns. Without wishing to be bound by theory, it is believed that when the binder has a size within these ranges, it disperses uniformly among the carbon microstructures.

When an interface layer is present, the binding phase comprises a binder layer comprising a binder and an interface layer bonding one of the at least two carbon microstructures to the binder layer. In an embodiment, the binding phase comprises a binder layer, a first interface layer bonding one of the carbon microstructures to the binder layer, and a second interface layer bonding the other of the at least two microstructures to the binder layer. The first interface layer and the second interface layer can have the same or different compositions.

The interface layer comprises one or more of the following: a C-metal bond; a C—B bond; a C—Si bond; a C—O—Si bond; a C—O-metal bond; or a metal carbon solution. The bonds are formed from the carbon on the surface of the carbon microstructures and the binder.

In an embodiment, the interface layer comprises carbides of the binder. The carbides include one or more of the following: carbides of aluminum; carbides of titanium; carbides of nickel; carbides of tungsten; carbides of chromium; carbides of iron; carbides of manganese; carbides of zirconium; carbides of hafnium; carbides of vanadium; carbides of niobium; or carbides of molybdenum. These carbides are formed by reacting the corresponding metal or metal alloy binder with the carbon atoms of the carbon microstructures. The binding phase can also comprise SiC formed by reacting $SiO_2$ or Si with the carbon of carbon microstructures, or $B_4C$ formed by reacting B or $B_2O_3$ with the carbon of the carbon microstructures. When a combination of binder materials is used, the interface layer can comprise a combination of these carbides. The carbides can be salt-like carbides such as aluminum carbide, covalent carbides such as SiC and $B_4C$, interstitial carbides such as carbides of the group 4, 5, and 6 transition metals, or intermediate transition metal carbides, for example the carbides of Cr, Mn, Fe, Co, and Ni.

In another embodiment, the interface layer comprises a solid solution of carbon such as graphite and a binder. Carbon has solubility in certain metal matrices or at certain temperature ranges, which can facilitate both wetting and binding of a metal phase onto the carbon microstructures. Through heat-treatment, high solubility of carbon in metal can be maintained at low temperatures. These metals include one or more of Co; Fe; La; Mn; Ni; or Cu. The binder layer can also comprise a combination of solid solutions and carbides.

The carbon composites comprise about 20 to about 95 wt. %, about 20 to about 80 wt. %, or about 50 to about 80 wt. % of carbon, based on the total weight of the composites. The binder is present in an amount of about 5 wt. % to about 75 wt. % or about 20 wt. % to about 50 wt. %, based on the total weight of the composites. In the carbon composites, the weight ratio of carbon relative to the binder is about 1:4 to about 20:1, or about 1:4 to about 4:1, or about 1:1 to about 4:1. The weight ratio of the carbon to the binder can be varied to obtain carbon composites having desired properties. To achieve large elasticity and to provide energized force for high sealing rate, less binder is used.

In addition to carbon composites, the seal can optionally contain at least one elastic metallic structure. The at least one elastic metallic structure comprise metals having porous structures and can be in the form of a V ring; an O ring; a C ring; or an E ring. Exemplary materials for the elastic metallic structures include one or more of the following: an iron alloy, a nickel-chromium based alloy, a nickel alloy, copper, or a shape memory alloy. An iron alloy includes steel such as stainless steel. Nickel-chromium based alloys include Inconel™. Nickel-chromium based alloys can contain about 40-75% of Ni and about 10-35% of Cr. The nickel-chromium based alloys can also contain about 1 to about 15% of iron. Small amounts of Mo, Nb, Co, Mn, Cu, Al, Ti, Si, C, S, P, B, or a combination comprising at least one of the foregoing can also be included in the nickel-chromium based alloys. Nickel alloy includes Hastelloy™. Hastelloy is a trademarked name of Haynes International, Inc. As used herein, Hastelloy can be any of the highly corrosion-resistant superalloys having the "Hastelloy" trademark as a prefix. The primary element of the Hastelloy™ group of alloys referred to in the disclosure is nickel; however, other alloying ingredients are added to nickel in each of the subcategories of this trademark designation and include varying percentages of the elements molybdenum, chromium, cobalt, iron, copper, manganese, titanium, zirconium, aluminum, carbon, and tungsten. Shape memory alloy is an alloy that "remembers" its original shape and that when deformed returns to its pre-deformed shape when heated. Exemplary shape memory alloys include Cu—Al—Ni based alloys, Ni—Ti based alloys, Zn—Cu—Au—Fe based alloys, and iron-based and copper-based shape memory alloys, such as Fe—Mn—Si, Cu—Zn—Al and Cu—Al—Ni.

The packoff element includes a wear-resistant member at least partially encapsulating the seal. In an embodiment, the wear-resistant member comprises a wear-resistant coating disposed on a surface of the seal. The wear-resistant coating can comprise a carbon composite and a reinforcing agent.

The carbon composites in the wear-resistant coating and the seal can be the same or different. In an embodiment, the carbon composite in the wear-resistant coating is the same as the carbon composite in the seal. In another embodiment, the binder in the wear-resistant coating has a higher corrosion/abrasion resistance as compared to the binder in the seal.

Erosion/abrasion resistant binders include one or more of the following: Ni; Ta; Co, Cr, Ti, Mo; Zr, Fe, W; and their alloys. It is appreciated that the erosion/abrasion resistant binders should be relatively ductile as well so that the seal can conform sufficiently to seal rough surfaces. Given their high toughness, the erosion resistant binders, if used, can be limited to wear-resistant coating. More ductile binders can be used in the seal. In this manner, the packoff can be erosion/abrasion resistant and at the same time deform sufficiently under limited setting force. In an embodiment, the binder in the carbon composite of the wear-resistant coating comprises an erosion/abrasion resistant binder.

The reinforcing agent in the wear-resistant coating comprises one or more of the following: an oxide, a nitride, a carbide, an intermetallic compound, a metal, a metal alloy, a carbon fiber; carbon black; mica; clay; a glass fiber; or a ceramic material. The metals include Ni; Ta; Co; Cr; Ti; Mo; Zr; Fe; or W. Alloys, oxides, nitrides, carbides, or intermetallic compounds of these metals can be also used. Ceramic materials include SiC, $Si_3N_4$, $SiO_2$, BN, and the like. Combinations of the reinforcing agent may be used. In an embodiment the reinforcing agent is not the same as the binder in the carbon composition of the first member or the carbon composite in the second member.

The weight ratio of the carbon composite to the reinforcing agent in the wear-resistant coating can be about 1:100 to about 100:1, about 1:50 to about 50:1, or about 1:20 to about 20:1. Advantageously, the wear-resistant coating has a gradient in the weight ratio of the carbon composite to the reinforcing agent. The gradient extends from an inner portion proximate the seal toward an outer portion away from the seal. The gradient can comprise a decreasing weight ratio of the carbon composite to the reinforcing agent from the inner portion of the wear-resistant coating to the outer portion of the wear-resistant coating. For example, the weight ratio of the carbon composite to the reinforcing agent may vary from about 50:1, about 20:1, or about 10:1 from the inner portion of the wear-resistant coating to about 1:50, about 1:20, or about 1:10 at the outer portion of the wear-resistant coating. In an embodiment, the gradient varies continuously from the inner portion of wear-resistant coating to the outer portion of the wear-resistant coating. In another embodiment, the gradient varies in discrete steps from the inner portion of the wear-resistant coating to the outer portion of the wear-resistant coating.

The wear-resistant coating may have any suitable thickness necessary to prevent the galling of the seal. In an exemplary embodiment, the wear-resistant coating has a thickness of about 50 microns to about 10 mm or about 500 microns to about 5 mm.

Alternatively, the wear-resistant member comprises a mesh encapsulating the seal, the mesh comprising one or more of a metal mesh; a glass mesh; a carbon mesh; or an asbestos mesh. The mesh pore size can be determined based on the specific application. In an embodiment, the mesh completely encapsulates the seal.

The packoff element comprises at least one guide member disposed on an end of the packoff element. In an embodiment, the packoff element contains two guide members disposed on opposing ends of the packoff element. The guide member can prevent collision between the seal and the PBR bore inner surface. In addition, the guide member can work tougher with other components of the packoff element in order to secure the packoff element to a mandrel.

In an embodiment, the packoff element further comprises a retainer member operably disposed between the guide member and a mandrel. Exemplary retainer member includes a C ring or split ring. In use, the retainer member is disposed between a recess on the guide member and a cooperative recess on a mandrel thus securing the guide member to a predetermined position on a mandrel.

The guide member can comprise one or more of the following: a metal; a metal alloy; a carbonaceous material; or a reinforced carbon composite. In an embodiment, the guide member comprises a nickel alloy, steel, graphite, or a carbon composite. The carbon composite can be a reinforced carbon composite comprising a carbon composite and a reinforcing agent as disclosed herein. In an embodiment, the guide member is formed of the same material as the seal; and the seal and the guide member form a one-piece component. Optionally, the wear-resistant coating also covers the guide member. It is appreciated that the guide member is well machined to achieve smooth surface so as not to scratch honed inner surface of PBR. The guide member can be in the form of a guide ring, for example.

The packoff element can also include a spacing member disposed between the guide member and the seal. Preferably, the spacing member is mechanically locked with the guide member. For example, the spacing member is externally threaded and the guide member is internally threaded, which can engage the threads of the spacing member. Optionally, the packoff element has a backup member attached to the seal. The backup member can be a backup ring.

The packoff elements can be configured and disposed to inhibit the passage of fluid. A packoff assembly for a casing bore receptacle defining a polished bore surface comprises: a tubing connectable mandrel having a polished external cylindrical surface portion; and at least one packoff element disposed on the mandrel, the packoff element comprising: an annular seal comprising a carbon composite and having an inner surface and an opposing outer surface; the inner surface being in contact with the polished external cylindrical surface portion of the mandrel; a wear-resistant member at least partially encapsulating the seal; an annular guide member disposed on the polished external cylindrical surface portion of the mandrel; and a retainer member disposed between the guide member and the mandrel for securing the guide member to a predetermined position on the mandrel. Spacing members and backup members as disclosed herein can be optionally included. In a specific embodiment, the packoff element of the assembly has opposing first and second ends and includes an annular seal; a wear-resistant member at least partially encapsulating the seal; a first annular guide member disposed on the first end of the packoff element; a second guide member disposed on the second end of the packoff element; a first retainer member disposed between the first annular guide member and the mandrel for securing the first guide member to a first position on the mandrel and a second retainer member disposed between the second annular guide member and the mandrel for securing the second guide member to a second position on the mandrel. As both the first guide member and the second guide member are secured to the mandrel, the seal between the first and second guide members can be positioned at a desired location on mandrel.

Figure 2:
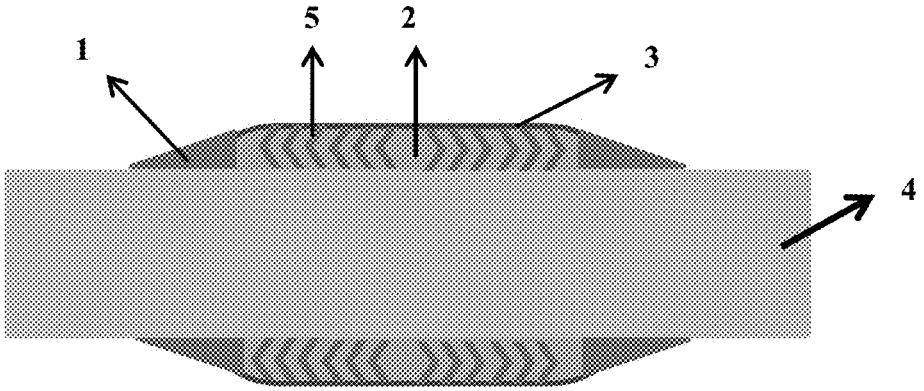
FIG. 2 illustrates the structure of a packoff assembly according to another embodiment of the disclosure.
Figure 3:
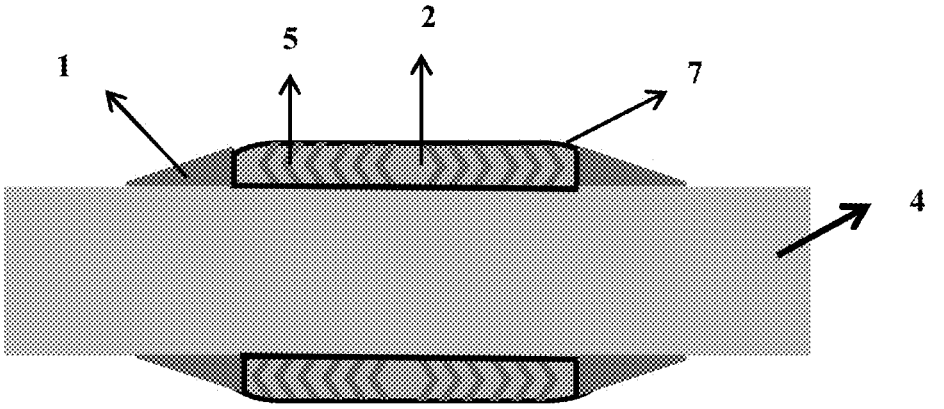
FIG. 3 illustrates the structure of a packoff assembly according to yet another embodiment of the disclosure.

Various embodiments of packoff assemblies are illustrated in FIGS. 1-3. As shown in FIG. 1, a packoff assembly comprises a mandrel 4, an annular seal 2, an annular guide member 1, and a wear-resistant coating 3 disposed on a surface of seal 2.

Referring to FIG. 2, in addition to carbon composites, seal 2 also contains elastic metallic structures 5. The packoff assembly in FIG. 2 contains a mandrel 4, a seal 2, a guide member 1, and a wear-resistant coating 3.

Figure 6:
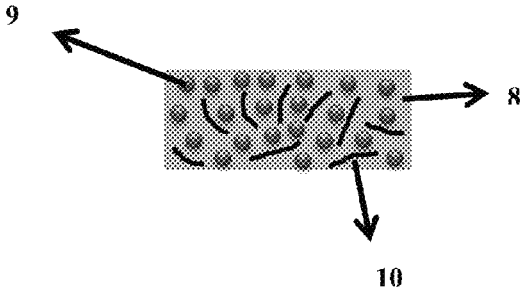
FIG. 6 illustrates the wear-resistant layer of the packoff element.

The structure of the wear-resistant coating 3 is illustrated in FIG. 6. As shown in FIG. 6, a wear-resistant coating can comprise carbon such as expanded graphite 8, binder 10, and reinforcing agent 9.

Referring to FIG. 3, the wear-resistant member in the packoff assembly is mesh 7, which completely encapsulates the seal 2. The packoff assembly illustrated in FIG. 3 contains mandrel 4, seal 2 which includes a carbon composite and elastic metallic structures 5, and a mesh 7.

Figure 4:
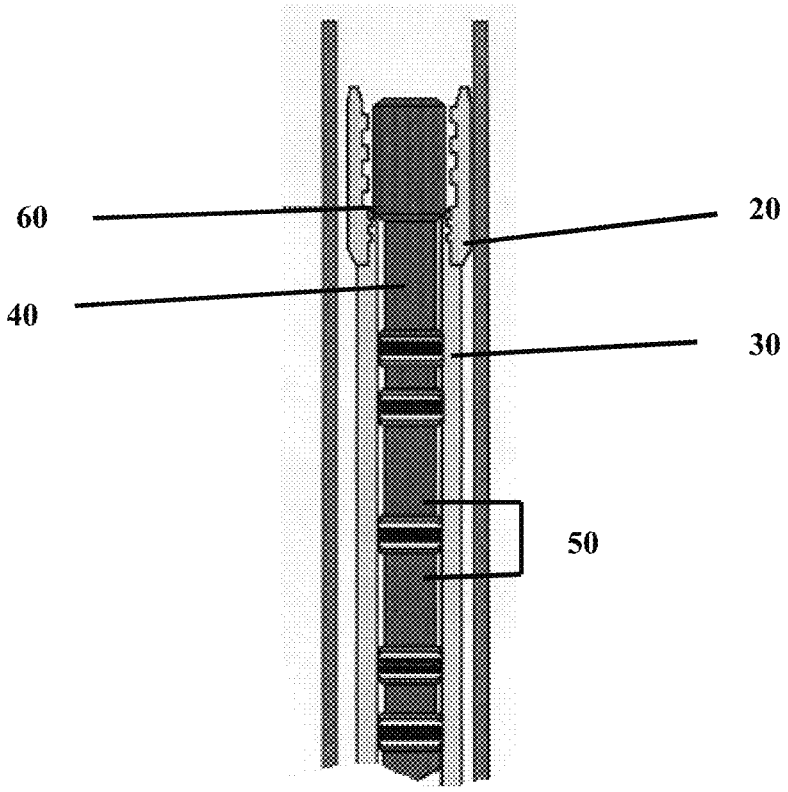
FIG. 4 illustrates the run-in of a packoff assembly with a casing bore receptacle.

A packoff assembly is illustrated in FIG. 4. As shown in FIG. 4 a packoff assembly includes a mandrel 40 and a plurality of packoff elements 50 disposed on the mandrel. The packoff element seals an annular space between the mandrel 40 and polished bore receptacle 30. The mechanism to engage the mandrel with the PBR is known in the art and is not particularly limited. Illustratively, the PBR 30 has an abutting means 20 which can engage a no-go should on mandrel 40.

Figure 5:
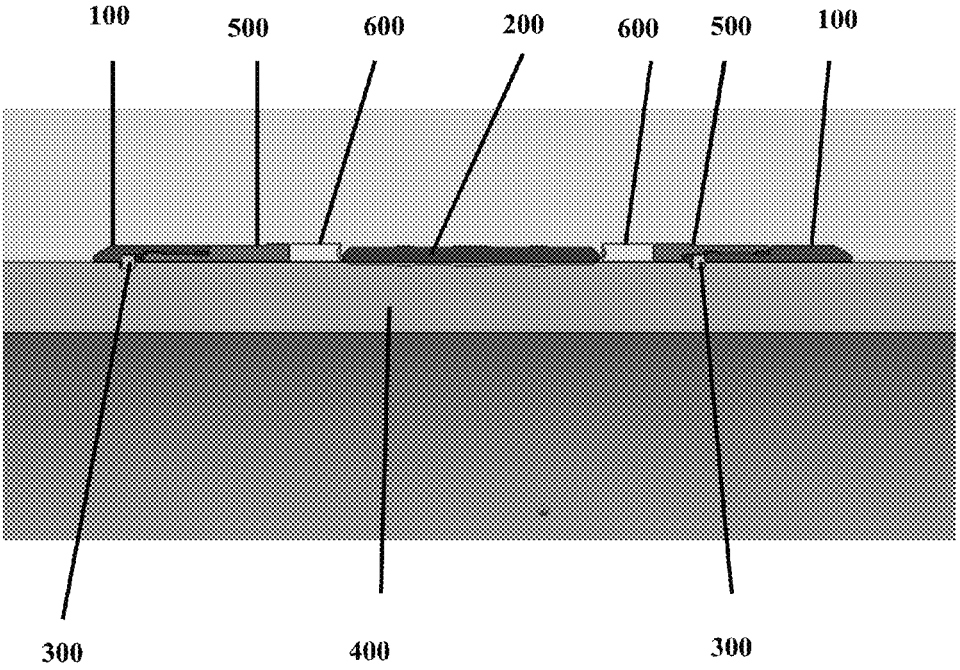
FIG. 5 is a cross-sectional view of an exemplary embodiment of a packoff element positioned on a mandrel.

FIG. 5 is a cross-sectional view of a packoff element. The exemplary packoff element has a mandrel 400, a seal 200 disposed on the mandrel, two guide members 100 located at opposing ends of the packoff element, two retainer rings 300 disposed between the guide member 100 and mandrel 400, two spacing rings 500 mechanically locked with the guide member 100, and back up rings 500 disposed between seal 200 and spacing rings 500. Each of the retainer rings 300 is positioned between a recess on the mandrel and a corresponding recess on the guide member, thus securing the packoff element to a desired position on mandrel 400.

A method of sealing comprises: positioning an annular packoff element onto a mandrel; guiding the packoff element towards a wellbore casing, for example, an inner surface of a casing bore receptacle; compressing the packoff element; and sealing an annular area between the mandrel and the wellbore casing such as the inner surface of the case bore receptacle.

Positioning the annular packoff element on a mandrel comprises disposing the retainer member on a cooperative recess on the mandrel. Guiding the packoff element towards a wellbore casing comprises sliding the guide member of the packoff element along a surface specifically a polished surface of a casing bore receptacle. In an embodiment, the packoff element is compressed when the packoff element is guided to a section of a casing bore receptacle having an inner bore diameter that is smaller than the outer diameter of the annular seal of the packoff element.

In an embodiment, when packoff assembly is lowered into a PBR bore, the guide member will slide along angled PBR inner surface to guide the seal smoothly into smaller ID region, where the seal is compressed or energized to provide reliable seal with honed PBR inner surface due to the excellent elasticity and conformability of the carbon composite material.

In addition to improved mechanical strength and high thermal conductivity, the carbon composites can also have excellent thermal stability at high temperatures. The carbon composites can have high thermal resistance with a range of operation temperatures from about −65° F. up to about 1200° F., specifically up to about 1100° F., and more specifically about 1000° F.

The carbon composites can also have excellent chemical resistance at elevated temperatures. In an embodiment, the carbon composites are chemically resistant to water, oil, brines, and acids with resistance rating from good to excellent. In an embodiment, the carbon composites can be used continuously at high temperatures and high pressures, for example, about 68° F. to about 1200° F., or about 68° F. to about 1000° F., or about 68° F. to about 750° F. under wet conditions, including basic and acidic conditions. Thus, the carbon composites resist swelling and degradation of properties when exposed to chemical agents (e.g., water, brine, hydrocarbons, acids such as HCl, solvents such as toluene, etc.), even at elevated temperatures of up to 200° F., and at elevated pressures (greater than atmospheric pressure) for prolonged periods.

Figure 7:
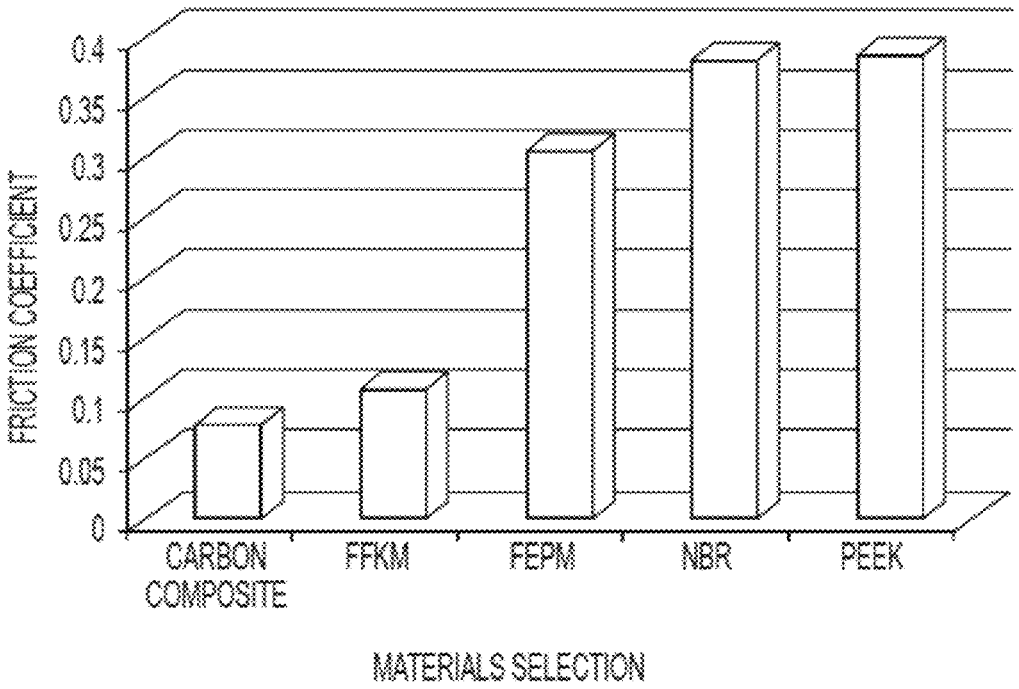
FIG. 7 shows the friction testing results of various materials.

The carbon composites can have excellent lubrication properties. FIG. 7 shows the friction testing results of carbon composite, FFKM (perfluoroelastomer available under the trade name Kalrez* from DuPont), FEPM (tetrafluoroethylene/propylene dipolymers), NBR (acrylonitrile butadiene rubber), and PEEK (polyetheretherketones). As shown in FIG. 7, among the samples tested, carbon composite provides the lowest friction coefficient.

The packoff elements and the packoff assemblies thus have reliable sealing properties in much harsher high temperature high pressure and corrosive conditions. In addition, the packoff elements and packoff assemblies can be set with a low setting force. The setting failures can also be minimized.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant(s) includes at least one colorants). "Or" means "and/or." "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. "A combination thereof" means "a combination comprising one or more of the listed items and optionally a like item not listed." All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While typical embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

What is claimed is:

1. A packoff element comprising
- a carbon composite seal;
- a wear-resistant member at least partially encapsulating the seal; and
- a guide member disposed on an end of the packoff element,
- wherein the carbon composite comprises carbon and a binder containing one or more of the following: $SiO_2$; Si; B; $B_2O_3$; a metal; or an alloy of the metal; the metal being one or more of the following: aluminum; copper; titanium; nickel; tungsten; chromium; iron; manganese; zirconium; hafnium; vanadium; niobium; molybdenum; tin; bismuth; antimony; lead; cadmium; or selenium.

2. The packoff element of claim 1, further comprising a retainer member for securing the guide member to a predetermined position on a mandrel.

3. The packoff element of claim 1, wherein the seal further comprises at least one elastic metallic structure.

4. The packoff element of claim 3, wherein at least one elastic metallic structure comprises a V ring; an O ring; a C ring; or an E ring.

5. The packoff element of claim 1, wherein the wear-resistant member comprises a wear-resistant coating disposed on a surface of the seal.

6. The packoff element of claim 5, wherein the wear-resistant coating comprises a carbon composite and a reinforcing agent comprising one or more of the following: an oxide, a nitride, a carbide, an intermetallic compound, a metal, a metal alloy, a carbon fiber; carbon black; mica; clay; a glass fiber; or a ceramic material.

7. The packoff element of claim 5, wherein the wear-resistant coating has a gradient in the weight ratio of the carbon composite to the reinforcing agent; and wherein the gradient comprises a decreasing weight ratio of the carbon composite to the reinforcing agent from the inner portion of the wear-resistant coating to the outer portion of the wear-resistant coating.

8. The packoff element of claim 1, wherein the wear-resistant member comprises a mesh encapsulating the seal, the mesh comprising one or more of a metal mesh; a glass mesh; a carbon mesh; or an asbestos mesh.

9. The packoff element of claim 1, wherein the guide member comprises a nickel alloy, steel, graphite, or a carbon composite.

10. A packoff assembly comprising:
- a tubing connectable mandrel; and
- at least one packoff element disposed on the mandrel;
- the packoff element comprising:
  - an annular seal comprising a carbon composite and having an inner surface and an opposing outer surface; the inner surface being in contact with a surface of the mandrel;
  - a wear-resistant member at least partially encapsulating the seal;
  - an annular guide member disposed on the mandrel; and
  - a retainer member disposed between the guide member and the mandrel for securing the guide member to a predetermined position on the mandrel,
  - wherein the carbon composite comprises carbon and a binder containing one or more of the following: $SiO_2$; Si; B; $B_2O_3$; a metal; or an alloy of the metal; the metal being one or more of the following: aluminum; copper; titanium; nickel; tungsten; chromium; iron; manganese; zirconium; hafnium; vanadium; niobium; molybdenum; tin; bismuth; antimony; lead; cadmium; or selenium.

11. The packoff assembly of claim 10, further comprising a spacing member disposed between the guide member and the seal, wherein the spacing member is mechanically locked with the guide member.

12. The packoff assembly of claim 10, further comprising a backup member attached to the seal.

13. The packoff assembly of claim 10, comprising
- a tubing connectable mandrel; and
- at least one packoff element disposed on a surface of the mandrel;
- the packoff element having an opposing first and second ends and comprising:
  - an annular seal comprising a carbon composite and having an inner surface and an opposing outer surface; the inner surface being in contact with a surface of the mandrel;
  - a wear-resistant member at least partially encapsulating the seal
  - a first annular guide member disposed on the first end of the packoff element;
  - a second annular guide member disposed on the second end of the packoff element;
  - a first retainer member disposed between the first guide member and the mandrel for securing the first guide member to the mandrel; and
  - a second retainer member disposed between the second guide member and the mandrel for securing the second guide member to the mandrel.

14. The packoff assembly of claim 13, wherein the seal is locked between the first guide member and the second guide member.

15. The packoff assembly of claim 10, wherein the wear-resistant member is a wear-resistant coating disposed on the outer surface of the annular seal.

16. The packoff assembly of claim 10, wherein the wear-resistant member is a mesh disposed on both the inner surface and the outer surface of the annular seal.

17. The packoff assembly of claim 10, wherein the annular seal further comprises at least one elastic metallic structure.

18. A method of sealing, the method comprising:

positioning at least one packoff element onto a mandrel;

guiding the packoff element towards a wellbore casing;

compressing the packoff element; and sealing an annular area between the mandrel and the wellbore casing, wherein the packoff element comprising;

a carbon composite seal;

a wear-resistant memeber at least partially encapsulating the seal; and a guide memeber disposed on an end of the packoff element, wherein the carbon composite comprises carbon and a binder containing one or more of the following: $SiO_2$; Si; B; $B_2O_3$; a metal; or an alloy of the metal; the metal being one or more of the following: aluminum; copper; titanium; nickel; tungsten; chromium; iron; manganese; zirconium; hafnium; vanadium; niobium; molybdenum; tin; bismuth; antimony; lead; cadmium; or selenium.

19. The method of claim 18, wherein the packoff element further comprises a retainer member disposed between the guide member and the mandrel for securing the guide member to the mandrel.

20. The method of claim 19, wherein positioning the annular packoff element on a mandrel comprises disposing the retainer member on a cooperative recess on the mandrel.

21. The method of claim 18, wherein guiding the packoff element towards a wellbore casing comprises sliding the guide member of the packoff element along an angled surface of a casing bore receptacle.

22. The method of claim 18, wherein the packoff element is compressed when the packoff element is guided to a section of a casing bore receptacle having an inner bore diameter that is smaller than the outer diameter of the annular seal of the packoff element.

23. The packoff assembly of claim 10, wherein the carbon composite comprises carbon microstructures held together by a binding phase comprising the binder.

24. The packoff assembly of claim 23, wherein the carbon microstructures have an aspect ratio of about 10 to about 500.

25. The packoff assembly of claim 23, wherein the binding phase has a thickness of about 0.1 to about 100 microns.

26. A packoff assembly comprising:

a tubing connectable mandrel; and at least one packoff element disposed on the mandrel;

the packoff element comprising:

an annular seal comprising a carbon composite and having an inner surface and an opposing outer surface; the inner surface being in contact with a surface of the mandrel;

a wear-resistant member at least partially encapsulating the seal;

an annular guide member disposed on the mandrel; and a retainer member disposed between the guide member and the mandrel for securing the guide member to a predetermined position on the mandrel, wherein the wear-resistant member comprises a mesh encapsulating the seal, the mesh comprising one or more of a metal mesh; a glass mesh; or an asbestos mesh, wherein the carbon composite comprises carbon and a binder containing one or more of the following: $SiO_2$; Si; B; $B_2O_3$; a metal; or an alloy of the matal; the metal being one or more of the following: aluminum; copper; titanium; nickel; tungsten; chromium; iron; manganese; zirconium; hafnium; vanadium; niobium; molybdenum; tin; bismuth; antimony; lead; cadmium; or selenium.

27. A packoff assembly comprising:

a tubing connectable mandrel; and at least one packoff element disposed on the mandrel;

the packoff element comprising:

an annular seal comprising a carbon composite and having an inner surface and an opposing outer surface; the inner surface being in contact with a surface of the mandrel;

a wear-resistant member at least partially encapsulating the seal;

an annular guide member disposed on the mandrel; and a retainer member disposed between the guide member and the mandrel for securing the guide member to a predetermined position on the mandrel, wherein the wear resistant member comprising a carbon composite and a reinforcing agent, the carbon composite in the wear resistance member comprising carbon and a binder containing one or more of the following: Ni; Ta; Co, Cr, Ti, Mo; Zr, Fe, W; or their alloys.

* * * * *